United States Patent [19]

Funami

[11] Patent Number: 5,041,033

[45] Date of Patent: Aug. 20, 1991

[54] HYDRAULIC PRESSURE MECHANISM FOR LIFTING AND LOWERING OUTBOARD ENGINE

[75] Inventor: Yasuo Funami, Saitama, Japan

[73] Assignee: Kabushiki Kaisha Showa Seisakusho, Japan

[21] Appl. No.: 549,203

[22] Filed: Jul. 6, 1990

[30] Foreign Application Priority Data

Jul. 6, 1990 [JP] Japan ..... 1-79797

[51] Int. Cl.[5] ..... B63H 5/12

[52] U.S. Cl. ..... 440/61; 188/318

[58] Field of Search ..... 440/53, 55, 56, 61, 440/65; 114/150; 188/318

[56] References Cited

U.S. PATENT DOCUMENTS 4,565,528 1/1986 Nakase ..... 440/61

4,957,457 9/1990 Probst et al. ..... 440/61

*Primary Examiner*—Jesus D. Sotelo

*Attorney, Agent, or Firm*—Merchant, Gould, Smith, Edell, Welter & Schmidt

[57] ABSTRACT

A hydraulic pressure mechanism for angularly lifting and lowering an outboard engine includes a hydraulic cylinder unit comprising a piston assembly and a hollow cylinder, the piston assembly being slidably fitted in the hollow cylinder and dividing a hollow space therein into a first oil chamber and a second oil chamber, a tank for storing working oil, a pump for delivering working oil from the tank to the hydraulic cylinder unit, and a spool valve for supplying working oil from the tank through the pump selectively and exclusively to the first and second oil chambers, thereby to cause the piston assembly and the cylinder to move relatively to each other for enabling the hydraulic cylinder unit to tilt the outboard engine. The cylinder has a tilt-limit hole defined in a side wall thereof in a range in which the piston assembly is slidable in the cylinder, so that the tilt-limit hole can be closed by the piston assembly thereby to limit sliding movement of the piston assembly with respect to the cylinder under at least external forces applied. The hydraulic pressure mechanism also has a valve for bringing the tilt-limit hole exclusively into communication with the tank through a flow passage.

6 Claims, 3 Drawing Sheets

HYDRAULIC PRESSURE MECHANISM FOR LIFTING AND LOWERING OUTBOARD ENGINE

BACKGROUND OF THE INVENTION

1. Field of the Invention

The present invention relates to a hydraulic pressure mechanism for supplying working oil to and discharging working oil from a tilt cylinder to angularly lift and lower an outboard engine at the stern of a marine vessel.

2. Description of the Relevant Art

Marine propulsion units for use on small marine vessels such as motorboats comprise an outboard engine, a stern bracket fixedly mounted on the transom of the motorboat hull, and a swivel bracket pivotally supported on the stern bracket, the outboard engine being mounted on the swivel bracket. The swivel bracket is vertically swung with respect to the stern bracket by a tilt cylinder unit, so that the underwater angle of the outboard unit can be adjusted and the outboard engine can be lifted out of water.

One conventional hydraulic pressure mechanism for supplying working oil to and discharging working oil from such a tilt cylinder unit is shown in FIG. 3 of the accompanying drawings. In FIG. 3, the hydraulic pressure mechanism is shown as being in a neutral position. To extend a tilt cylinder unit 103 from the neutral position, a pump 100 is rotated in a normal direction to supply working oil to a righthand port P1 of a spool valve 101 to develop a pressure buildup which opens a check valve 102. Now, the working oil is supplied from the check valve 102 to a lower oil chamber S2 in the tilt cylinder 103, thus moving a piston 104 thereof to the right. At this time, a valve body 105 of the spool valve 101 is moved to the left by the pressure buildup applied to the righthand port P1, causing a lefthand projection on the valve body 105 to push open a check valve 106. Therefore, working oil in an upper oil chamber S1 in the tilt cylinder unit 103 flows through a lefthand port P2 of the spool valve 101 back to the pump 100.

To contract the tilt cylinder unit 103, the pump 100 is reversed to supply and discharge the working oil in the opposite directions to those described above. The tilt cylinder unit 103 has a free piston 111, a damping force generating valve 112, and a check valve 113.

After the lower oil chamber S2 in the tilt cylinder 103 is supplied and filled up with working oil and the piston 104 reaches the upper limit in the upper oil chamber S1 by normal rotation of the pump 100, excessive working oil from the pump 100 returns to a tank 107 through a valve 109 (up-blow valve). After the upper oil chamber S1 in the tilt cylinder unit 103 is supplied and filled up with working oil by reverse rotation of the pump 100, excessive working oil from the pump 100 returns to the tank 107 through a valve 108 (down-blow valve).

When the marine vessel is landed, the tilt cylinder unit 103 may be left extended. At this time, the working oil which is filled in the oil chamber S2 is expanded with the heat of sunlight or the like. When the pressure of the expanded working oil exceeds a preset release pressure level of a valve 110 (thermal-blow valve), the valve 110 is opened allowing the working oil to flow therethrough back to the tank 107. Therefore, the cylinder unit 103 is prevented from being burst.

With the conventional hydraulic circuit which has the valve 110, a pressure buildup higher than the release pressure level of the valve 110 may be developed by propulsive forces produced by the outboard engine, rather than the heat of sunlight. For example, such high propulsive forces may be produced when the ship runs in the shallows. At this time, the piston 104 of the cylinder unit 103 may not be kept in the middle position which allows the ship to run in the shallows, and the ship may not be able to run in the shallows. To avoid this, a stopper or the like is mounted on the stern bracket or the like for mechanically preventing the outboard engine from swinging down beyond a certain angle.

SUMMARY OF THE INVENTION

In view of the aforesaid shortcomings of the conventional hydraulic pressure mechanism for use with outboard engines, it is an object of the present invention to provide a hydraulic pressure mechanism which can keep the trim of an outboard engine reliably against a high pressure which can be produced by propulsive forces of the outboard engine or some external forces.

According to the present invention, there is provided a hydraulic pressure mechanism for angularly lifting and lowering an outboard engine, comprising a hydraulic cylinder unit comprising a piston assembly and a hollow cylinder, the piston assembly being slidably fitted in the hollow cylinder and dividing a hollow space therein into a first oil chamber and a second oil chamber, a tank for storing working oil, pump means for delivering working oil from the tank to the hydraulic cylinder unit, spool valve means for supplying working oil from the tank through the pump means selectively and exclusively to the first and second oil chambers, thereby to cause the piston assembly and the cylinder to move relatively to each other for enabling the hydraulic cylinder unit to tilt the outboard engine, the cylinder having a tilt-limit hole defined in a side wall thereof in a range in which the piston assembly is slidable in the cylinder, so that the tilt-limit hole can be closed by the piston assembly thereby to limit sliding movement of the piston assembly with respect to the cylinder under at least external forces applied, and communication means for bringing the tilt-limit hole exclusively into communication with the tank through a flow passage.

The above and further objects, details and advantages of the present invention will become apparent from the following detailed description of a preferred embodiment thereof, when read in conjunction with the accompanying drawings.

DESCRIPTION OF THE PREFERRED EMBODIMENT

Figure 1:
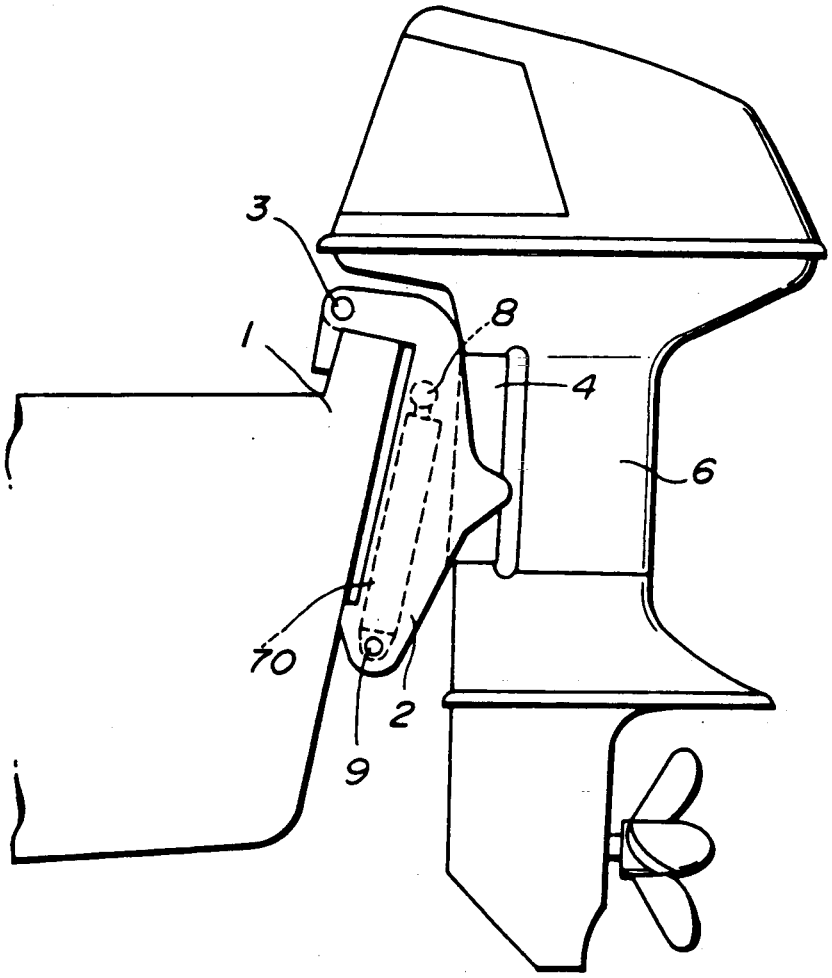
FIG. 1 is a schematic side elevational view of the stern of a small marine vessel and an outboard engine mounted thereon, with a hydraulic pressure mechanism for lifting and lowering the outboard engine according to the present invention.

As shown in FIG. 1, a pair of laterally spaced stern brackets 2 is fixed to a stern plate 1. A swivel bracket 4 is vertically swingably supported on a horizontal shaft 3 which is disposed between the stern brackets 2. An outboard engine 6 has a vertical shaft (not shown) which rotatably extends through a pipe (not shown) on the center of the swivel bracket 4. Therefore, the outboard engine 6 is vertically and horizontally swingable with respect to the stern plate 1.

A hydraulically operated tilt cylinder unit 70 is positioned in a space which is surrounded by the stern plate 1, the stern brackets 2, and the swivel bracket 4. The tilt cylinder unit 70 has a piston rod with its upper end coupled to the swivel bracket 4 through a pin 8, and a cylinder with its lower end coupled to the stern brackets 2 through a pin 9.

Figure 2:
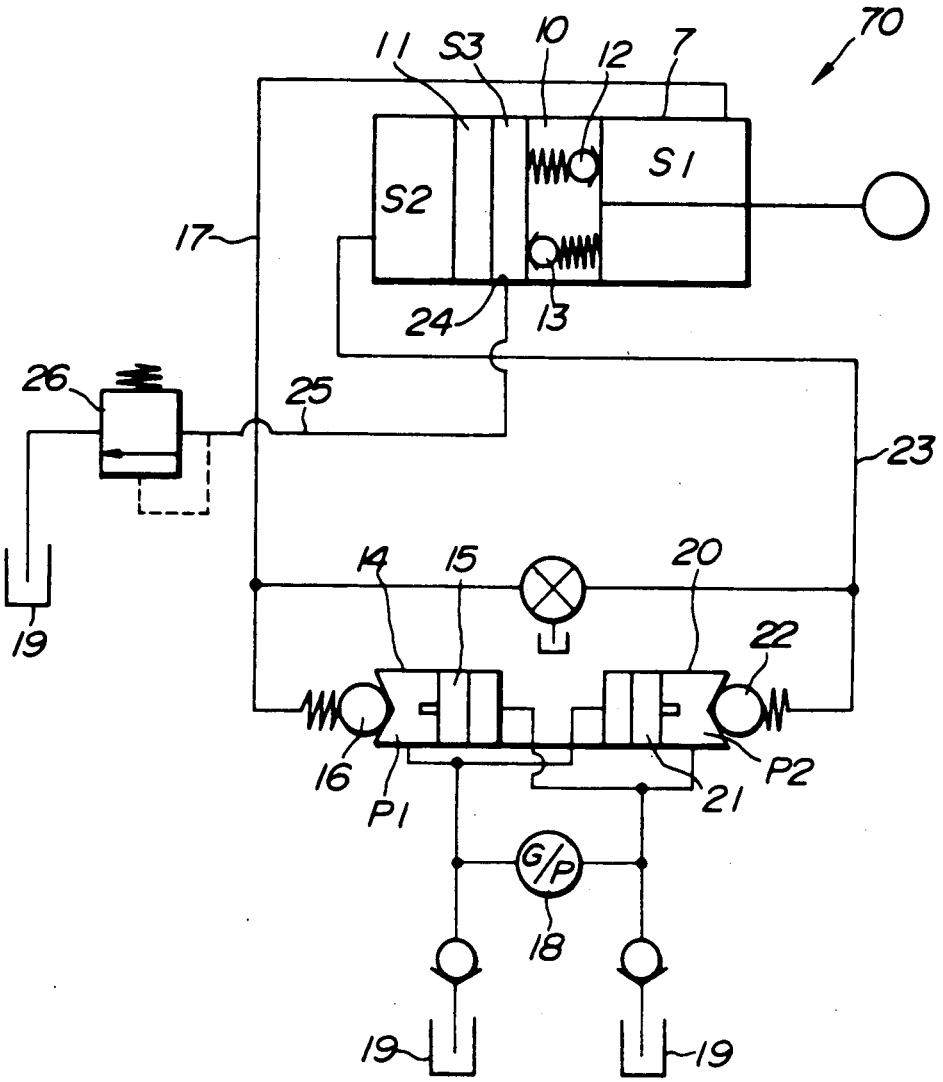
FIG. 2 is a schematic circuit diagram of the hydraulic pressure mechanism according to the present invention.
Figure 3:
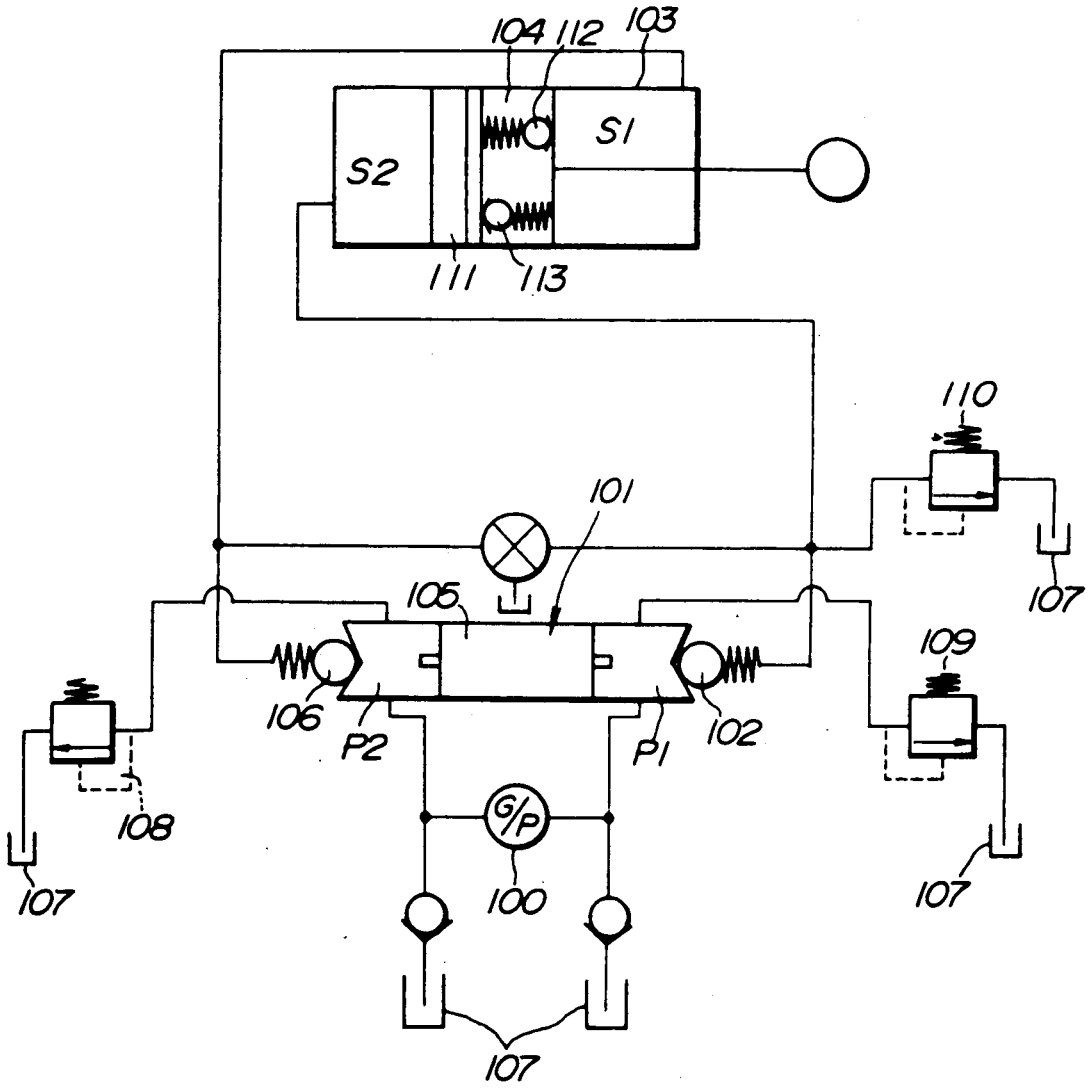
FIG. 3 (PRIOR ART)
FIG. 3 is a schematic circuit diagram of a conventional hydraulic pressure mechanism for lifting and lowering an outboard engine.

As shown in FIG. 2, the tilt cylinder unit 70 comprises a hollow cylinder 7 and a piston 10 slidably fitted in the hollow cylinder 7. The piston 10 divides the inner space of the cylinder 7 into an upper oil chamber S1 and a lower oil chamber S2.

A free piston 11 is slidably fitted in the lower oil chamber S2 in the hollow cylinder 7, and an intermediate oil chamber S3 is defined between the free piston 11 and the piston 10. The piston 10 has two oil passages defined therein which accommodate respectively therein a damping force generating valve 12 which is openable when the tilt cylinder unit 70 is extended and a check valve 13 which is openable when the tilt cylinder unit 70 is contracted.

The upper oil chamber S1 in the cylinder 7 is supplied with working oil, which is delivered from a tank 19 by a pump 18, through a spool valve 14 having a valve body 15, a check valve 16, and a flow passage 17. The lower oil chamber S2 is supplied with working oil from the tank 19 through a spool valve 20 having a valve body 21, a check valve 22, and a flow passage 23.

According to the present invention, the cylinder 7 has a tilt-limit hole 24 defined in a side wall thereof and opening into the lower oil chamber S2 or the intermediate oil chamber S3. The tilt-limit hole 24 communicates with the tank 19 through a discharge flow passage 25, which extends to the tank 19 without joining any other flow passages and has a valve 26 that is openable under a predetermined pressure.

The discharge flow passage 25 would be arranged to join the flow passage 17 which communicates with the upper oil chamber S1. With such an arrangement, however, working oil delivered to the upper oil chamber S1 by the pump 18 would flow through the discharge flow passage 25 and the tilt-limit hole 24 into the lower oil chamber S2. To prevent such an oil flow, a check valve would have to be disposed in the discharge flow passage between the tilt-limit hole and the joint of the passages 25, 17. Furthermore, when the cylinder unit 70 is extended due to a log jump, which is caused by a collision of the outboard engine with driftwood, the valve 26 would be opened before the damping force generating valve 12 is opened, and desired damping forces would not be generated by the damping force generating valve 12. For these reasons, the discharge flow passage 25 is arranged not to join any other flow passages.

Operation of the hydraulic circuit shown in FIG. 2 will be described below.

To tilt the outboard engine 6 downwardly, the pump 18 is rotated in a normal direction from the neutral condition shown in FIG. 2, supplying working oil from the tank 19 to a port P1 of the spool valve 14 and a back side of the spool valve 20. The check valve 16 is opened by a pressure buildup applied to the port P1, and the check valve 22 is opened by a projection on the valve body 21 of the check valve 22. The working oil is now supplied through the check valve 16 and the flow passage 17 to the upper oil chamber S1, so that the piston 10 is moved to the left (FIG. 2). The volume of the lower oil chamber S2 is reduced, forcing working oil through the check valve 22 back to the pump 18. After the outboard engine 6 is fully tilted downwardly, i.e., when the piston 10 and the free piston 11 reaches their lower limits in the cylinder 7 in order to expand the upper oil chamber S1 beyond the tilt-limit hole 24, any excessive working oil which is continuously supplied from the pump 18 to the upper oil chamber S1 that has already been filled up flows through the tilt-limit hole 24, opening the valve 26, and returns to the tank 19.

To tilt the outboard engine 6 upwardly, the pump 18 is rotated in a reverse direction to supply working oil from the tank 19 to a port P2 of the spool valve 20 and a back side of the spool valve 14. The check valve 22 is opened by a pressure buildup applied to the port P2, and the check valve 16 is opened by a projection on the valve body 15 of the check valve 16. The working oil is now supplied through the check valve 22 and the flow passage 23 to the lower oil chamber S2. The free piston 11 and the piston 10 are moved to the right (FIG. 2). Working oil which is forced out of the cylinder 7 by a reduction in the volume of the upper oil chamber S1 flows through the check valve 16 back to the pump 18. After the outboard engine 6 is fully tilted upwardly, i.e., when the piston 10 and the free piston 11 reaches their upper limits in the cylinder 7 in order to expand the lower oil chamber S2 beyond the tilt-limit hole 24, any excessive working oil which is continuously supplied from the pump 18 to the lower oil chamber S2 that has already been filled up flows through the tilt-limit hole 24, opening the valve 26, and returns to the tank 19.

When propulsive forces generated by the outboard engine 6 are increased, i.e., the ship is accelerated, while the piston 10 is in the intermediate position in the cylinder 7 (typically when the ship runs in the shallows), reactive forces from the outboard engine 6 are transmitted through the piston rod to the piston 10, which is then retracted into the cylinder 7. At this time, working oil in the lower oil chamber S2 flows through the tilt-limit hole 24 and the check valve 26 into the tank 19. The retraction of the piston 10 (or the free piston 11) then closes the tilt-limit hole 24 which is positioned in the cylinder side wall to allow the piston to be retracted a given distance from the intermediate position in the cylinder 7. When the tilt-limit hole 24 is closed, the working oil is confined in the lower oil chamber S2 and not discharged therefrom. Therefore, the piston 10 is no longer retracted into the cylinder 7, and the outboard engine 6 is held in such an angular position as to allow the ship to run in the shallows. In FIG. 2, the intermediate position for the piston 10 is positioned upstream of the tilt-limit hole 24 with respect to the flow of working oil from the flow passage 17 through the upper oil chamber S1 and the tilt-limit hole 24 into the discharge flow passage 25.

The valve 12 in the piston 10 serves as a shock valve to absorb shocks caused when the outboard engine 6 collides with foreign matter such as driftwood. When the outboard engine 6 collides with driftwood, the free piston 11 is effective to return the piston 10 back to a position before such a collision.

With the present invention, as described above, the side wall of the tilt cylinder has a tilt-limit hole defined therein which is held in communication with the oil tank through the discharge flow passage, which does not join any other flow passages and has a valve that is openable under a predetermined pressure. The hydraulic pressure mechanism thus constructed allows the outboard engine to be tilted and trimmed, as usual, and also permits the trim of the outboard engine to be maintained for travel in shallows. The functions of an up-blow valve, a down-blow valve, and a thermalblow valve, which would otherwise be required as is the case with the conventional hydraulic pressure mechanism, are performed by only the valve 26. Accordingly, the hydraulic pressure mechanism is compact as a whole, and is constructed of a reduced number of parts and can be assembled in a reduced number of steps.

In the illustrated embodiment, the tilt-limit hole 24 is positioned such that, when the piston 10 is in the intermediate position in the cylinder 7, the tilt-limit hole 24 opens into the lower oil chamber S2 or the intermediate oil chamber S3. Therefore, when the piston 10 and the cylinder 7 are relatively contracted under external forces applied, the tilt-limit hole 24 limits the retraction of the piston 10 into the cylinder 7. However, the present invention is not limited to this construction, but may be modified in other ways. For example, the tilt-limit hole 24 may be positioned so as to open into the upper oil chamber S1 when the piston 10 is in the intermediate position, so that, when the piston 10 and the cylinder 7 are relatively extended under external forces applied, the tilt-limit hole 24 thus positioned is effective to limit the relative extension of the piston 10 with respect to the cylinder 7.

Although there has been described what is at present considered to be the preferred embodiment of the present invention, it will be understood that the invention may be embodied in other specific forms without departing from the essential characteristics thereof. The present embodiment is therefore to be considered in all aspects as illustrative, and not restrictive. The scope of the invention is indicated by the appended claims rather than by the foregoing description.

I claim:

1. A hydraulic pressure mechanism for angularly lifting and lowering an outboard engine, comprising:

a hydraulic cylinder unit comprising a piston assembly and a hollow cylinder, said piston assembly being slidably fitted in said hollow cylinder and dividing a hollow space therein into a first oil chamber and a second oil chamber;

a tank for storing working oil;

pump means for delivering working oil from said tank to said hydraulic cylinder unit;

spool valve means for supplying working oil from said tank through said pump means selectively and exclusively to said first and second oil chambers, thereby to cause said piston assembly and said cylinder to move relatively to each other for enabling said hydraulic cylinder unit to tilt the outboard engine;

said cylinder having a tilt-limit hole defined in a side wall thereof in a range in which said piston assembly is slidable in said cylinder, so that said tilt-limit hole can be closed by said piston assembly thereby to limit sliding movement of said piston assembly with respect to said cylinder under at least external forces applied; and communication means for bringing said tilt-limit hole exclusively into communication with said tank through a flow passage.

2. A hydraulic pressure mechanism according to claim 1, wherein said communication means comprises valve means disposed in said flow passage, for allowing working oil to flow from said tilt-limit hole back to said tank under a predetermined or higher pressure.

3. A hydraulic pressure mechanism according to claim 2, wherein said spool valve means comprises means for supplying working oil from said tank to said first oil chamber to move said piston assembly toward said second oil chamber and for discharging excess oil from said first oil chamber through said tilt-limit hole back to said tank, for thereby enabling said hydraulic cylinder unit to tilt the outboard engine upwardly.

4. A hydraulic pressure mechanism according to claim 2, wherein said spool valve means comprises means for supplying working oil from said tank to said second oil chamber to move said piston toward said first oil chamber and for discharging excess working oil from said second oil chamber through said tilt-limit hole back to said tank, for thereby enabling said hydraulic cylinder unit to tilt the outboard engine downwardly.

5. A hydraulic pressure mechanism according to claim 3, wherein said piston assembly is positionable at an intermediate position in said cylinder to keep the outboard engine in an angular position suitable for travel in shallows, said intermediate position being positioned upstream of said tilt-limit hole with respect to the working oil as it is supplied and discharged, and in a region extending from said tilt-limit hole toward said second oil chamber.

6. A hydraulic pressure mechanism according to claim 1, wherein said piston assembly comprises a piston and a free piston which is positioned on a first oil chamber side of said piston.

* * * * *

UNITED STATES PATENT AND TRADEMARK OFFICE

CERTIFICATE OF CORRECTION

PATENT NO. : 5,041,033

DATED : August 20, 1991

INVENTOR(S) : Yasuo Funami

It is certified that error appears in the above-identified patent and that said Letters Patent is hereby corrected as shown below:

On the cover page under the heading of "Foreign Application Priority Data", "Jul. 6, 1990" should read as --Jul. 6, 1989--.

Column 6, line 27, claim 3; insert --working-- after the word "excess".

Signed and Sealed this

Third Day of August, 1993

*Attest:*

Michael K. Kirk

MICHAEL K. KIRK

*Attesting Officer*

*Acting Commissioner of Patents and Trademarks*